United States Patent [19]

Asahi

[11] 4,391,260

[45] Jul. 5, 1983

[54] FLUID PRESSURE RESPONSIVE VALVE DEVICE

[75] Inventor: Kiyonobu Asahi, Anjo, Japan

[73] Assignee: Aisin Seiki Kabushiki Kaisha, Kariya, Japan

[21] Appl. No.: 214,786

[22] Filed: Dec. 9, 1980

[30] Foreign Application Priority Data

Dec. 17, 1979 [JP] Japan ..... 54-164322

[51] Int. Cl.[3] ..... F02M 25/06

[52] U.S. Cl. ..... 123/568; 137/869; 137/DIG. 8

[58] Field of Search ..... 123/568; 137/869, DIG. 8

[56] References Cited

U.S. PATENT DOCUMENTS 4,058,098 11/1977 Onaka ..... 123/568

4,181,254 1/1980 Yoshihiro et al. ..... 137/DIG. 8 X 4,231,336 11/1980 Yuuki ..... 123/568

*Primary Examiner*—Gerald A. Michalsky

*Attorney, Agent, or Firm*—Oblon, Fisher, Spivak, McClelland & Maier

[57] ABSTRACT

A fluid pressure responsive valve device including a body having an inlet port, a signal pressure port and first and second outlet ports formed therein, a member disposed within the body being movable in response to fluid pressure communicated to the signal pressure port, a hollow rod secured to the movable member and including a part of a first passage member connecting the inlet port and the first outlet port, a second passage member for connecting the inlet port and the second outlet port and a plurality of valve members arranged within the first and second passages, respectively, to thereby control fluid communication through the first and second passage members in response to movement of the movable member.

8 Claims, 1 Drawing Figure

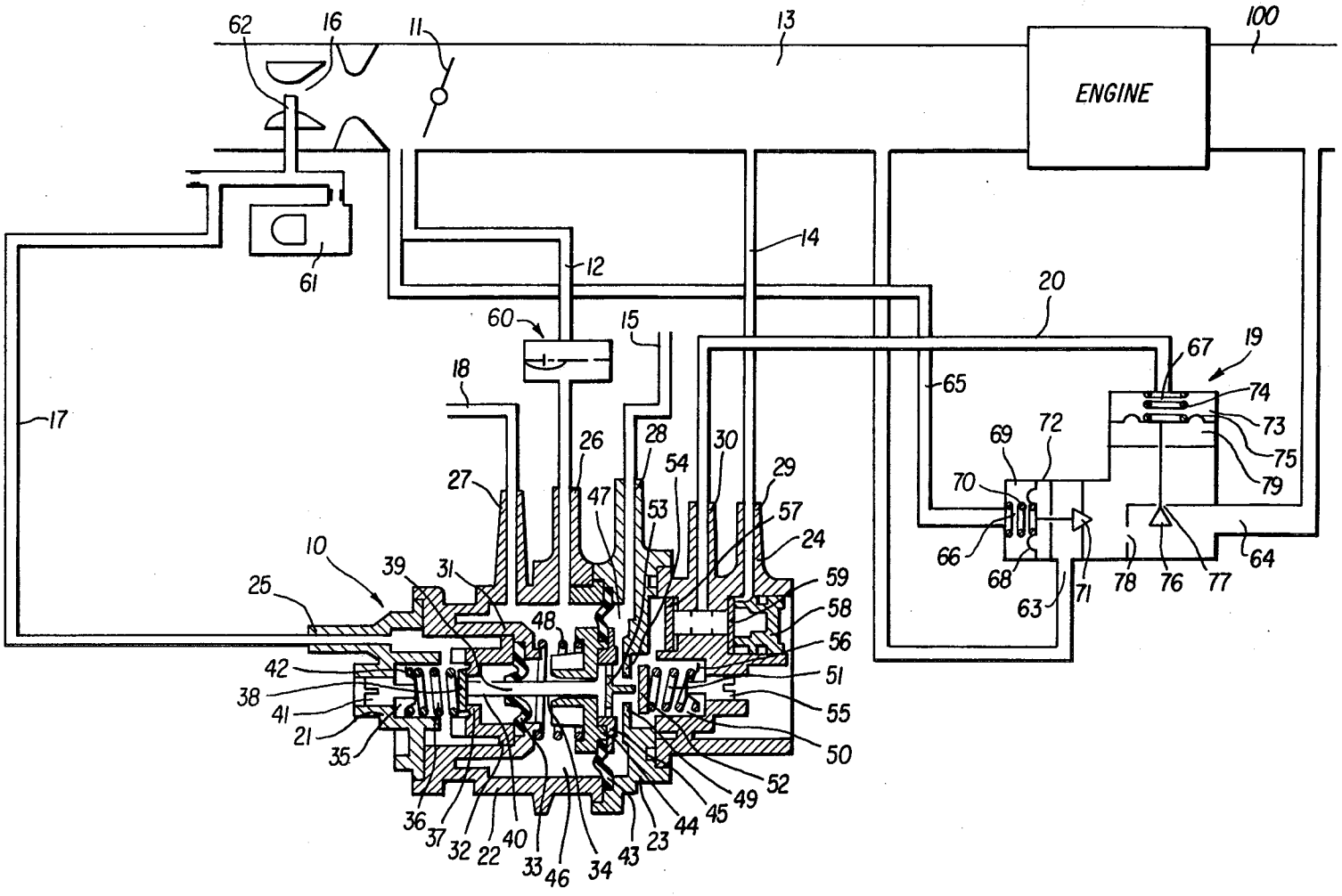
ENGINE

FLUID PRESSURE RESPONSIVE VALVE DEVICE

BACKGROUND OF THE INVENTION

1. Field of the Invention

This invention relates to a valve device, and more particulatly to a fluid pressure responsive valve device for on-off controlling a plurality of fluid passages in response to a signal fluid pressure.

2. Description of the Prior Art

Conventionally, various emission control systems for vehicles have been proposed to reduce HC, CO, NOx and the like within the exhaust gases.

These systems will be expected to be operated in response to drive conditions of the vehicle so as to not thereby reduce drivability. Thus, each system has a valve device to thereby independently control the operation of each system in response to drive conditions. This means that each valve has to be arranged within each system and accordingly a complicated piping arrangement will be required. This results in high cost and in complicated pipe construction within a limited space within the vehicle itself.

SUMMARY OF THE INVENTION

It is therefore, an object of the present invention to provide an improved fluid pressure responsive valve which obviates the prior art drawbacks mentioned above.

It is another object of the present invention to provide an improved single fluid pressure responsive valve which controls a plurality of fluid passages.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several views, and wherein:

In the accompanying drawing, the Sole FIGURE is a cross sectional view of a fluid pressure responsive valve device according to the present invention which is arranged within an emission control system which is, in turn, shown as schematic diagram.

DETAILED DESCRIPTION OF THE PREFERRED EMBODIMENT

A fluid pressure responsive valve device 10 according to the present invention is connected to a passage 12 which is positioned above a throttle valve 11 to thereby receive vacuum pressure in response to the degree of opening of the throttle valve 11, a passage 14 to thereby receive vacuum pressure generated at an engine intake manifold 13, a passage 15 to thereby receive atmospheric pressure; a passage 17 leading to a venturi 16 of a carburetor, a passage 18 leading to an air injection system and a passage 20 leading to an exhaust gas recirculation system 19, respectively.

The fluid pressure responsive valve device 10 has four bodies 21–24 which are secured to one another, first body 21 having an outlet port 25 which is connected to passage 17, second body 22 inlet and outlet ports 26 and 27 which are connected to passages 12 and 18, respectively, third body 23 having inlet port 28 which is connected to passage 15, and fourth body 24 having inlet and outlet ports 29 and 30 which are connected to passages 14 and 20, respectively. A diaphragm 33 has its outer periphery inserted between inward extension 31 of second body 22 and seat member 32 secured to the extension 31 and has its inner periphery securely positioned on a hollow rod 34. Thus the diaphragm 33 defines a chamber 35 which leads to outlet port 25.

A valve member 38 is arranged within chamber 35 and is usually urged to be in contact with a seat portion 37 of seat member 32 by means of a spring 36. The valve member 38 may be spaced from seat portion 37 in response to movement of rod 34, as will be explained hereinafter, to thereby cause a passage 39 within rod 34 to be in communication with chamber 35 through means of an opening 40 provided in the rod 34. The biasing force may be adjusted by means of a retainer 42 which is displaced in response to turning movement of screw 41 which is sealingly threaded through body 21.

A diaphragm 43 has its outer periphery securely positioned between second and third bodies 22 and 23 and has its inner periphery securely positioned between plates 44 which securely holds one end of rod 34 and plate 45 secured to plate 44. Thus, the diaphragm 43 is movable in response to a change in signal fluid pressure, and defines a chamber 46 which leads to ports 26 and 27 and a chamber 47 which leads to port 28. The plate 44 is continuously biased by means of a spring 48 the other end of which is seated against second body 22.

The third body 23 has an inward extension 49 to thereby define chamber 50 which is in communication with chamber 47. A valve member 52 arranged within chamber 50 is biased by means of spring 51. The valve member 52 is normally disposed in its open position to thereby allow fluid communication between chambers 47 and 50 by means of valve actuating member 53 which is arranged within chamber 47, and in contact with valve member 52 at one end thereof and may be in contact with plate 44 at the other end thereof. Valve member 52 is moved so as to be in contact with seat 54 provided on extension 49 by means of spring 51 upon leftward movement of plate 44 and, thus, fluid communication between chambers 47 and 50 will be interrupted.

The right end of passage 39 defined by hollow rod 34 is opened to chamber 47. The biasing force of spring 51 will be adjusted by means of a retainer 56 and screw 55 threaded through fourth body 24 in the same manner as that of spring 36. Chamber 50 is connected to port 30 by means of a filter 57 and port 29 is connected to port 30 by means of a filter 59 supported by a cap 58 such that filters 57 and 59 may operate as an orifice.

Assuming that the vehicle is operating under a low load such as in an idling condition, throttle valve 11 is positioned as shown in the FIGURE, and atmospheric pressure will prevail within passage 12 and vacuum pressure of a substantially maximum value will prevail within passage 14. This means that atmospheric pressure will prevail within chamber 46 and, the diaphragm with plates 44 and 45 and rod 34 will be maintained in its illustrated position by means of spring 48. Therefore, valve actuating member 53 is urged rightwardly by means of plate 44 to thereby cause valve member 52 to disengage from seat 54.

Fluid communication between chambers 47 and 50 is now allowed. Thus, vacuum pressure transmitted to port 30 from intake manifold 13 through port 29 is reduced by means of bleeding of atmospheric pressure through port 28. Under these conditions, valve member 38 is brought into contact with seat 37 by means of spring 36 to thereby interrupt fluid communication between chambers 47 and 35.

When the vehicle is operated under a driving condition involving a middle or intermediate load and throttle valve 11 is opened such that vacuum pressure will prevail within passage 12, vacuum pressure is transmitted to chamber 46 by means of vacuum pressure transmitting delay mechanism 60 including a one way check valve and orifice. When vacuum pressure within chamber 46 overcomes biasing force of spring 48, diaphragm 43 with plates 44, 45 and rod 34 will be moved to the left since atmospheric pressure prevails within chamber 47.

In response to movement of plate 44, valve actuating member 53 and valve member 52 follow by means of spring 51 and as a result, valve member 52 is brought into contact with seat 54 to thereby interrupt fluid communication between chamber 47 and 50. Therefore, a relatively high intake manifold vacuum pressure at port 29 will prevail within port 30. Leftward movement of rod 34 will cause valve member 38 to disengage from seat 37 against spring 36 and, as a result, chamber 47 is connected to port 25 through means of passage 39 and opening 40.

When the vehicle is operated under a driving condition of high load and the opening degree of throttle valve 11 is further increased, the vacuum pressure within passage 12 is reduced and therefore, plates 44, 45 and rod 34 are returned to their illustrated original positions by means of spring 48. Parts of valve device 10 are thus positioned in the same positions as those under driving condition of low load. It is noted that parts of valve device 10 are also returned to their illustrated positions when the vehicle driving condition is changed from a middle load condition to a low load condition. It is further noted that parts of valve device 10 will be quickly returned to their illustrated positions due to the arrangement of a check valve of vacuum transmitting delay mechanism 60 when the vehicle engine is suddenly decelerated.

Since the fluid pressure responsive valve device 10 operates as herebefore noted, when port 25 receives atmospheric pressure through means of chamber 47, atmospheric pressure is transmitted to passage 62 which serves to connect float chamber 61 of the gasoline tank with venturi 16. Thus, the valve device is applied within air-fuel ratio control system to provide a lean air-fuel ratio.

A control valve 19 for exhaust gas recirculation includes outlet port 63 which is in communication with intake manifold 13 and inlet port 64 which is in communication with the exhaust manifold 100. Valve 19 also includes inlet port 66 which receives intake manifold vacuum pressure through passage 65, and inlet port 67 which is in communication with port 30.

Sufficient vacuum pressure will prevail within passage 65 during a middle load vehicle driving condition. When this vacuum pressure is transmitted through inlet port 66 to chamber 69 which is defined by diaphragm 68, valve 71 secured to diaphragm 68 is moved toward the left against spring 70 to thereby complete fluid communication between inlet and outlet ports 64 and 63, respectively. Thus, part of the exhaust gases will be recirculated to the intake manifold. During driving conditions of low and high loads, vacuum pressure within chamber 69 through passage 65 will be reduced. Diaphragm 68 with valve 71 will be now urged in its original and illustrated position by spring 70, and valve 71 will interrupt recirculation of exhaust gas. Numeral 72 denotes an atmospheric chamber.

Fluid pressure which communicates with inlet port 67 functions as a pressure signal for the quantity of exhaust gas recirculation. When a sufficient vacuum pressure prevails in chamber 73 through inlet port 67, this vacuum pressure will urge valve 76 secured to diaphragm 75 against spring 74 to thereby interrupt passage 77 between inlet port 64 and valve 71. At this time, fluid communication between inlet port 64 and valve 71 will be completed only by means of passage 78. When vacuum pressure within chamber 73 will be reduced, valve 76 secured to diaphragm 75 is moved into its open position by means of spring 74 whereby fluid communication between inlet port 64 and valve 71 will be completed through means of both passages 77 and 78. Numeral 79 denotes an atmospheric pressure chamber.

As will be clear from the discussion hereinabove, insofar as vacuum pressure within passage 65 will be low such during the driving conditions of low and high loads, valve 71 will be maintained in its closed position and, therefore, recirculation of exhaust gas will be interrupted regardless of the conditions of fluid pressure responsive valve device 10. When the vehicle is operated under the driving condition of middle loading, chamber 69 receives sufficient vacuum pressure to cause valve 71 to move into its open position to thereby complete fluid communication between inlet and outlet ports 64 and 63 whereby a part of the exhaust gases will be recirculated. Under these conditions, passages 77 will be selectively on-off or open-closed controlled in response to a signal pressure which is transmitted to inlet port 67 from outlet port 30 of valve device 10 so that the quantity of exhaust gas recirculation will be properly controlled. More particularly, it is desired that parts of valve device 10 are designed such that port 30 is interrupted from communication with atmospheric pressure, but is connected to port 29 during the time the vehicle operates under the driving condition of middle loading and the opening degree of throttle valve 11 is relatively small. Thus, chamber 73 receives intake manifold vacuum pressure and valve 76 will interrupt passage 77.

Recirculation of exhaust gases will be completed only by means of passage 78 and thus the quantity thereof will be relatively small. When the degree of opening of throttle valve 11 is relatively large although the vehicle still operates under a driving condition of middle loading, it is desired that such is so that parts of valve device 10 will be returned to their illustrated position. Under these conditions, vacuum pressure which is transmitted to chamber 73 will be reduced and valve 76 will be moved into its open position whereby the quantity of exhaust gas recirculation will be increased since recirculation of exhaust gases will be completed by means of both passages 77 and 78.

As will be clear from the foregoing, it is desired that the time of operation of valve device 10 and time of operation of valve 19 especially with respect to valve 71 will be different. Port 27 may also be connected by means of passage 18 to a valve device which controls the injection of air into the exhaust manifold and the like. The fluid pressure responsive valve 10 mentioned above according to the present invention may be applied to other exhaust gas cleaning and emission control systems.

Obviously, many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A fluid pressure responsive valve device including an exhaust gas recirculation device, said fluid pressure responsive valve device comprising:

a body having an inlet port, at least one signal pressure port connected to an engine intake means and first and second outlet ports formed therein, means disposed within said body movable in response to fluid pressure communicated to said signal pressure port, a hollow rod secured to said movable means and comprising a part of a first passage member connecting said inlet port and said first outlet port, a second passage member for connecting said inlet port and said second outlet port, said second passage member including restriction means, said second outlet port being in fluid communication with said exhaust gas recirculation device, and a plurality of first valve means arranged within said first and second passages, respectively, to thereby control fluid communication through said first and second passage members in response to movement of said movable means, wherein said exhaust gas recirculation device comprises a third passage member connected between an engine exhaust manifold and said intake means, said third passage member including parallel flow portions, wherein said exhaust gas recirculation device further comprises second valve means connected to said intake means for selectively closing said third passage member and third valve means connected to said third passage member for selectively closing one of said parallel flow portions of said third passage member.

2. A fluid pressure responsive valve device as claimed in claim 1, said movable means comprising a diaphragm and a pair of plates secured to said diaphragm.

3. A fluid pressure responsive device as set forth in claim 1, said movable means comprising:

a first diaphragm connected at its inner periphery to said hollow rod; and a second diaphragm and a pair of plates secured to said diaphragm for securing said second diaphragm within said body.

4. A fluid pressure responsive valve device as set forth in claims 2 or 3, wherein one plate of said pair of plates is secured to an end portion of said hollow rod.

5. A fluid pressure responsive valve device as set forth in claims 1, 2 or 3, said body comprising at least a first and second body member and said plurality of valve means comprising a first and second valve member disposed in said first and second body members, respectively.

6. A fluid pressure responsive valve device as set forth in claim 5, further comprising a valve actuating member disposed in said body between one of said first and second valve members and said hollow rod.

7. The device of claim 1 including a third outlet port in said body, said third outlet port being connected to a further fluid pressure controlled device.

8. The device of claims 1 or 7 which said at least one signal pressure port includes a signal pressure port connected between said intake means and said second passage member.

* * * * *